US005479728A

United States Patent [19]

Deken et al.

[11] Patent Number: 5,479,728

[45] Date of Patent: Jan. 2, 1996

[54] APPARATUS FOR BACKFILLING AND TAMPING A TRENCH

[75] Inventors: Arthur D. Deken; James E. Franklin; Cody L. Sewell, all of Perry, Okla.

[73] Assignee: The Charles Machine Works, Inc., Perry, Okla.

[21] Appl. No.: 207,174

[22] Filed: Mar. 8, 1994

[51] Int. Cl.[6] ..... E02F 5/22

[52] U.S. Cl. ..... 37/142.5; 405/179; 405/271; 172/40; 172/155; 404/133.2

[58] Field of Search ..... 37/142.5, 347, 37/363, 365; 111/189; 172/40, 675, 155, 158; 405/179, 271; 404/122, 121, 127, 130, 133.2

[56] References Cited

U.S. PATENT DOCUMENTS

| | | | |
|---|---|---|---|
| 2,891,335 | 6/1959 | Linneman . | |
| 3,181,258 | 5/1965 | Duncan | 37/142.5 |
| 3,427,940 | 2/1969 | MacDonald . | |
| 3,471,953 | 10/1969 | Wyatt | 37/142.5 |
| 3,590,702 | 7/1971 | Sechi . | |
| 3,595,145 | 7/1971 | Mozdzanowski . | |
| 3,599,543 | 8/1971 | Kerridge . | |
| 3,656,419 | 4/1972 | Boone . | |
| 3,680,452 | 8/1972 | Mangum . | |
| 3,693,513 | 9/1972 | Borsutzki et al. . | |
| 3,722,380 | 3/1973 | Kaltenegger . | |
| 3,722,381 | 3/1973 | Tuneblom . | |
| 3,736,066 | 5/1973 | Koontz . | |
| 3,737,244 | 6/1973 | Wilson . | |
| 3,741,669 | 6/1973 | Harris . | |
| 3,797,954 | 3/1974 | Harris . | |
| 3,807,067 | 4/1974 | Cloud | 37/142.5 |
| 3,814,531 | 6/1974 | Carnahan et al. . | |
| 3,814,532 | 6/1974 | Barrett et al. . | |
| 3,822,957 | 7/1974 | Caron et al. . | |
| 3,861,475 | 1/1975 | Kuncewicz | 172/71 |
| 3,909,147 | 9/1975 | Takata . | |
| 3,934,363 | 1/1976 | McMurray | 37/142.5 X |
| 4,149,253 | 4/1979 | Paar et al. . | |
| 4,269,535 | 5/1981 | Schultz . | |
| 4,283,867 | 8/1981 | Brown | 37/142.5 |
| 4,302,129 | 11/1981 | Arenz . | |
| 4,334,799 | 6/1982 | Rautenbach et al. . | |
| 4,523,486 | 6/1985 | Bueno . | |
| 4,546,425 | 10/1985 | Breitholtz . | |
| 4,647,247 | 3/1987 | Sandstrom . | |
| 4,732,507 | 3/1988 | Artzberger . | |
| 4,759,659 | 7/1988 | Copie . | |

(List continued on next page.)

FOREIGN PATENT DOCUMENTS

| | | |
|---|---|---|
| 2525252 | 4/1982 | France . |

OTHER PUBLICATIONS

Liljedahl et al., Tractors and Their Power Units, Third Edition, ©1979, p. 336, John Wiley & Sons, Inc.

Advertisement, Pack Wheel, manufactured by TSR, Inc.

Advertisement, Twin Pack, manufactured by TSR, Inc.

Advertisement, McCullough Cover–Up, manufactured by M&E Soil Service.

*Primary Examiner*—David H. Corbin
*Assistant Examiner*—Victor Batson
*Attorney, Agent, or Firm*—Richards, Medlock & Andrews

[57] ABSTRACT

A backfiller and tamper unit (10) is disclosed which is a self contained unit that acts to both backfill and compact soil into a trench for complete restoration. The unit includes a tractor (12) which mounts a vibrator and tamping wheel assembly (14) and a backfill auger assembly (16). The vibrator and tamping wheel assembly (14) is mounted on a mast (50) which is pivotally secured to the tractor for limited arcuate motion from vertical. This permits the mast to be tilted so that the compaction force of the vibrator and tamping wheel assembly is most effectively directed to compact the soil in the trench. The vibrator and tamping wheel assembly is free floating on the mast which isolates the tractor from vibration generated by the vibrator and tamping wheel assembly and provides greater compaction efficiency. Further, the vibrator and tamping wheel assembly can be lifted vertically on the mast by a lift mechanism (62) for storage.

17 Claims, 3 Drawing Sheets

U.S. PATENT DOCUMENTS 4,771,377 9/1988 Wiser et al. .
4,867,606 9/1989 Wright ..... 405/271
4,912,862 4/1990 Bishop et al. ..... 37/142.5
4,913,581 4/1990 Weiler .
4,981,396 1/1991 Albertson et al. ..... 37/142.5 X
5,046,891 9/1991 Vural .
5,082,396 1/1992 Polacek .
5,219,380 6/1993 Young et al. .
5,353,529 10/1994 McCullough .

FIG. 5
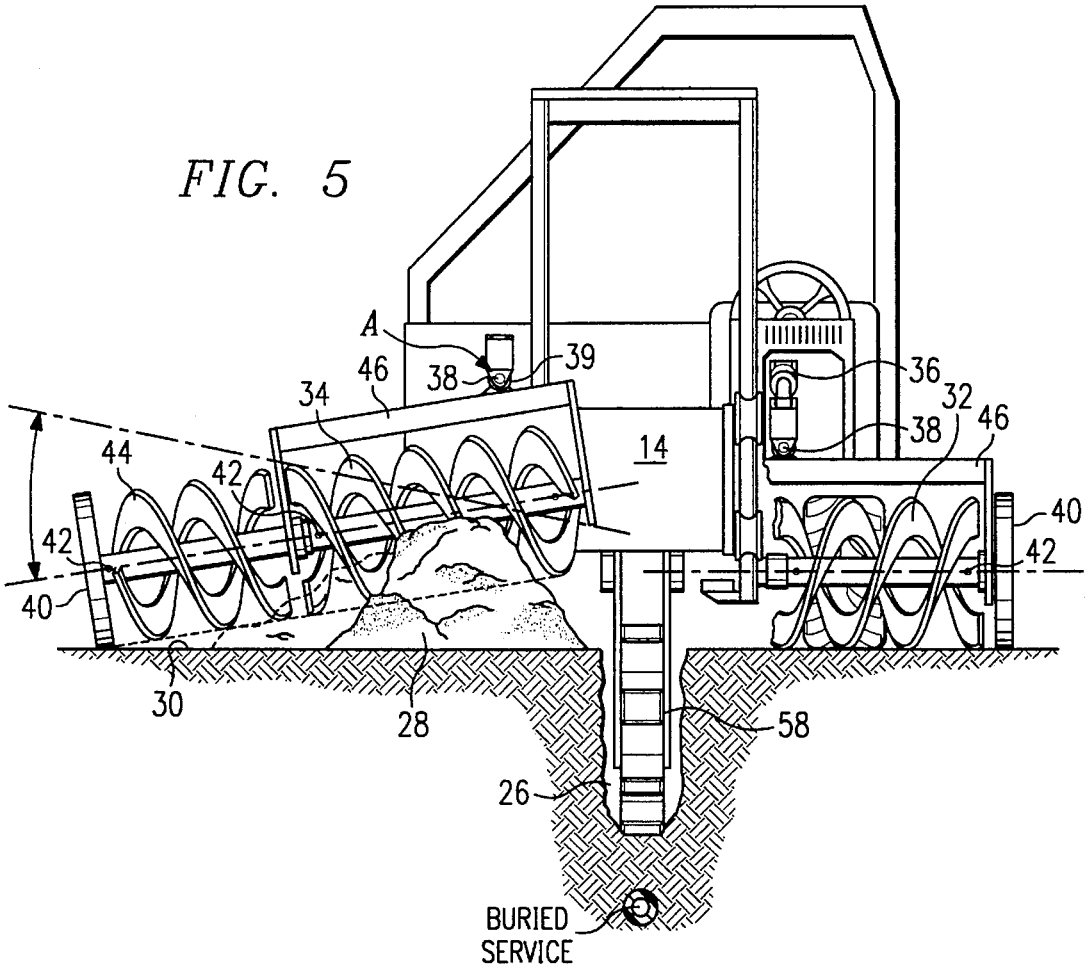
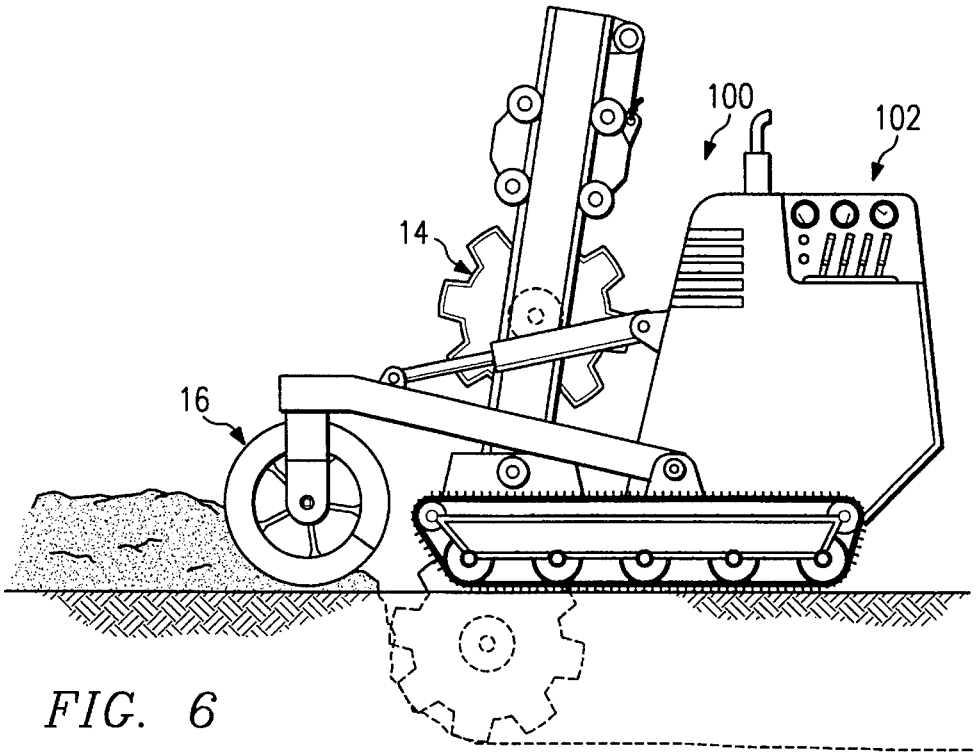
FIG. 6

APPARATUS FOR BACKFILLING AND TAMPING A TRENCH

BACKGROUND OF THE INVENTION

In installing underground services, or repairing services already in place, it is quite common to dig a narrow deep trench along the line of the service to the depth at which the service is to be run or to expose the existing service for repair and maintenance. The soil removed from the trench is typically placed on the ground surface immediately adjacent the trench in the area commonly known as the right of way.

After the service has been installed or repaired, the trench is refilled with the soil. However, the compaction of the soil is typically less than the undisturbed ground and the soil will commonly overfill the trench, leaving a mound. In the past, various methods and mechanisms have been used to attempt to compact the soil. Specifically, wheels, drums, plates, both static and vibratory, have been employed. All of these have been used in a multitude of configurations, such as rider, walk behind, hand held and the like, and with varying degrees of success. None of the prior devices address the unique problem of returning all of the spoil to a narrow trench. The soil is also quite prone to subsidence as time passes, often necessitating additional efforts to maintain the proper grade level.

Because of these facts, the task of trenching to permit the installation or repair of utility services and the restoration of the site back to its preexisting condition, specifically soil density and surface condition, is time consuming and costly. Many times, the trenching crew must return to the site to repair subsidence of the surface and other problems that render the site either unsafe or unsightly. The correction of these problems is usually at the contractor's expense.

A need therefore has arisen to develop an apparatus and method whereby the backfilling and compaction of the soil can be done more efficiently and cost effectively. Of specific interest is the ability to compact the soil sufficiently at the time the trench is filled so that subsidence does not occur. Thus, the trencher crew can avoid the costs and difficulty of having to return to a site later.

SUMMARY OF THE INVENTION

In accordance with one aspect of the present invention, an apparatus is provided for backfilling a trench and compacting soil sufficiently to restore the site. The apparatus includes a tractor and at least one auger mounted on the tractor to move soil from the right of way into the trench. A tamper assembly is mounted on the tractor to tamp the soil into the trench to a compaction comparable with the undisturbed soil to restore the site. In accordance with other aspects of the present invention, the tractor can be hydraulically powered with four-wheel drive. Right and left augers can be employed which are supported at one end by a roller on the ground.

The tamper assembly can include a tamping wheel and a vibrating assembly mounted on a mast. The vibrating and tamping wheel assembly is mounted for movement along the mast to move between a position for tamping and compacting the soil and a position for transport of the apparatus. The vibrating and tamping wheel assembly is free-floating on the mast so that the energy of the vibration will be delivered directly to the soil to enhance the compaction. Preferably, the mast can be tilted from vertical to provide the best angle for operation of the vibrating and tamping wheel assembly. The mast is preferably mounted between the front wheels and ahead of the operator's position to provide good visibility.

In accordance with another aspect of the present invention, a mechanism is provided for tamping soil into a trench. The mechanism includes a frame, a mast mounted on the frame and a tamping wheel assembly mounted to the mast for movement along the length of the mast. A vibrator is preferably mounted on the tamping wheel assembly. The mast is also mounted on the frame to permit the mast to be tilted from vertical to direct the tamping forces against the soil being compacted in the trench.

The self-contained machine of the present invention will backfill and tamp a trench in several passes (trips up and down the trench). It is a dedicated self-propelled rider machine capable of saving the trenching contractor time and money in the restoration of narrow trench excavations. As can be realized, various components and assemblies can be removed from the dedicated self-propelled rider machine and be made available as attachments to other prime movers for the purposes indicated. Thus, these components may be reconfigured to perform the same functions on a variety of other machines, including but not limited to, a small self-propelled walk behind machine. The added benefit of not having to return to the job site at a future date to fill in subsidence can be realized with this machine.

BRIEF DESCRIPTION OF THE DRAWINGS

For a more complete understanding of the present invention and for further advantages thereof, reference is now made to the following description of the preferred embodiment, taken in conjunction with the accompanying drawings in which:

FIG. 5 is a front view of the apparatus illustrating the float of the auger when encountering an uneven surface; and FIG. 6 is an illustrative view of an apparatus forming a second embodiment of the present invention which is a small, self-propelled walk behind machine.

DETAILED DESCRIPTION

Figure 1:
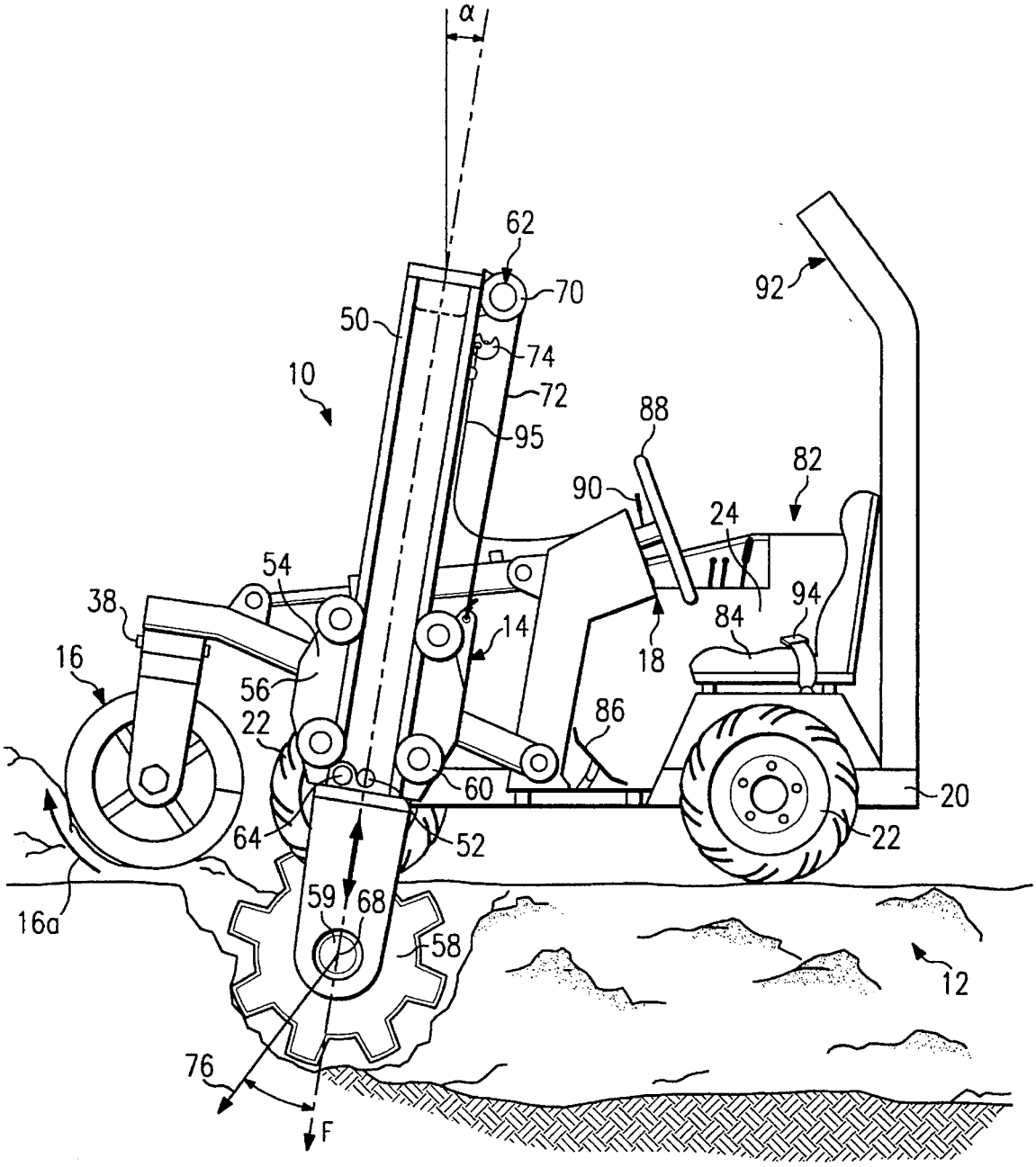
FIG. 1 is a side view of an apparatus forming a first embodiment of the present invention.

With reference now to the drawings, a backfiller tamper machine 10 forming a first embodiment of the present invention is illustrated. The unit includes four major subassemblies, including a tractor 12, a vibrator and tamping wheel assembly 14 mounted on the tractor, a backfill auger assembly 16 and an operator interface 18 for controlling the operation of the tractor and assemblies 14 and 16.

The tractor includes a frame 20 supported on the ground by four wheels, including two front wheels 22 and two rear wheel 22. The front pair of wheels are steerable by the operator to guide the unit 10 in the desired direction. For greater control under some circumstances, such as tamping while driving in reverse, rear or all wheel steer may be a desired option.

A power unit 24, typically a diesel engine, is mounted on the frame to provide motive power to the unit as well as to power the vibrator and tamping wheel assembly 14 and the backfill auger assembly 16. Preferably, the power unit 24 will drive a plurality of hydraulic pumps for powering the various functions of the unit. Each wheel 22 is preferably driven by an individual hydraulic motor to provide traction. For backfilling and compacting trenches having a width of from four to twelve inches wide and up to 48 inches deep, with 42 inches of cover over the top of the service, the unit would preferably be driven by a 40 horsepower diesel engine. The total weight of this unit would be expected to be about 3800 pounds. However, it will be understood that the unit can be made in any size suitable for the particular trench width and depth to be refilled and compacted.

Figure 2:
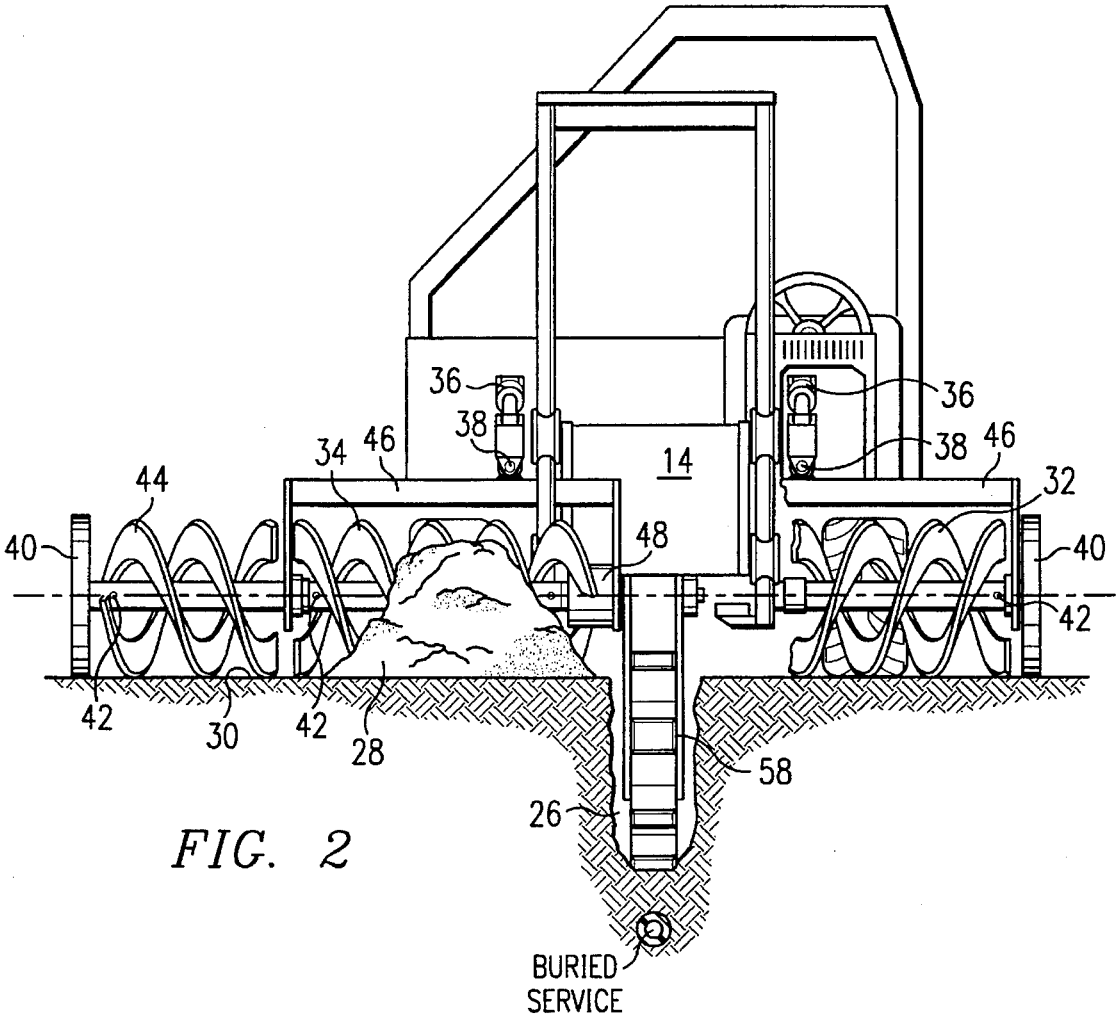
FIG. 2 is a front view of the apparatus.

As best seen in FIG. 2, the unit 10 is preferably driven along the trench 26 to be backfilled with the machine straddling the trench. The backfill auger assembly 16 will rotate in the direction of the arrow shown in FIG. 1 and drive the soil 28 from the right of way 30 into the trench.

The backfill auger assembly 16 includes a left auger 32 and a right auger 34. Each auger is supported in the vertical direction by a lift cylinder 36 which allows the auger to be moved between a position engaging the ground and a position lifted above the ground for transport and an infinite number of positions between to permit the controlled metering of soil from the pile in the right-of-way into the trench and ahead of the tamping wheel in preparation for tamping. The soil must be returned to the trench in a plurality of passes in order to achieve the proper density. Although varying with soil type and moisture content, typically, proper density can only be achieved in lift thicknesses (depths) of 4 to 8 inches. Also, each auger is mounted through a mechanical pivot 38 which allows the auger to float and thereby follow uneven terrain. As seen in FIG. 5, each auger can pivot independently about pivot 38 to accommodate an uneven spoil pile or uneven terrain. There is a stop 39 to restrict the downward movement of the outer end of the augers about pivot 38 to permit raising the augers to sufficient height for transport and loading of the machine on a trailer. Each auger rotates, raises and lowers and pivots independently of the other, allowing the operator to select either or both augers depending on the task to be performed. To permit ease of operation, each auger is controlled by one hydraulically operated lift cylinder. The pivot 38 is a free floating pivot. As is understood, in order to place all of the soil back in the trench during restoration of the job site, it is necessary to return the soil in a plurality of lifts (layers) of a depth sufficient to allow sufficient tamping force from the tamping wheel to pack the soil. To insure that the proper amount of soil is returned in each lift, multiple trips (passes) must be made and proper metering of the soil into the trench realized by the independent raising and lowering (control) of each auger (right and left) assembly.

At the outside end of each of the augers 32 and 34 is mounted a free wheeling roller 40 which supports the outer end of the augers on the ground and prevents them from digging into the surface of the unexcavated ground. The rollers 40 are installed in a removable manner in a hex socket at the end of the augers and are held in place with a bale style pin 42. There are conditions whereby the free wheeling rollers may not be needed. The rollers may be removed and the augers will still perform their function. The pin 42 can be removed and the roller 40 removed as well for installation of an extension auger 44 to either or both the augers 32 and 34, as seen in FIG. 2. The extension auger is secured to the outer end of auger 32 or 34 by the bale pin 42 and the free wheeling roller 40 is, in turn, secured to the outer end of the extension auger 44 by a bale pin 42 to support the augers on the ground. The extension augers are used to manage the larger volume of soil produced by a single side discharge trenching machine or larger spoil piles of deeper and wider trenchers. The extension augers 44 can be stored atop the auger frames 46 when not in use. Each of the augers 32 and 34 is rotated through a dedicated direct drive hydraulic motor 48 mounted on the auger frame 46.

Each auger is rotated in a direction to move the soil forward and toward the middle of the machine to deposit the soil into the trench 26 ahead of the vibrator and tamping wheel assembly 14 as the machine moves forward. By rotating the augers in the direction **16*a* shown in FIG. 1**, the augers lift packed soil, fluff it and break up clods. In a typical installation, the augers can be a left hand and a right hand helix, double flight with a 24" diameter and a length of 36". The extension augers can be 18" long. It can also be realized that other methods of moving the soil from the right of way may be employed such as rotating brooms made of bristles of wire or plastic, or mold board (blade) in a "V" configuration.

The vibrator and tamping wheel assembly 14 is mounted in a free floating manner on a vertical mast 50. Mast 50 is mounted to the frame in front of the operator interface 18 but behind the front wheel 22. The mast is also pivotally mounted to the frame through pivot pin 52, which allows the mast to be tilted rearward from vertical by a hydraulic cylinder (not shown) to enhance the compaction effect of the vibrator and tamping wheel assembly 14 on the soil as will be discussed in greater detail hereinafter.

The vibrator and tamping wheel assembly 14 includes a carriage 54 which mounts a vibrator 56, a tamping wheel 58, rollers 60, lift mechanism 62 and connecting pins 64.

Figure 3:
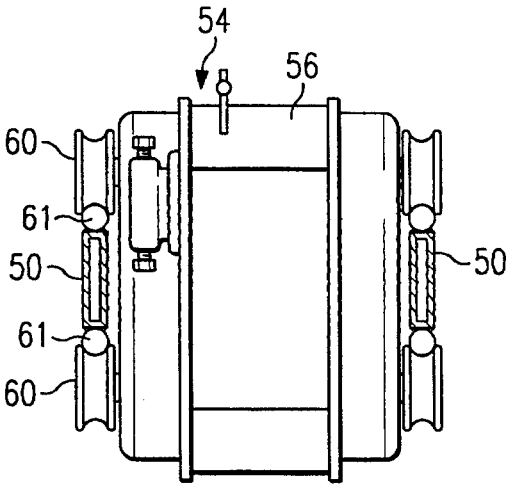
FIG. 3 is a cross-sectional view of the vibrator and tamping wheel assembly forming a portion of the apparatus.
Figure 4:
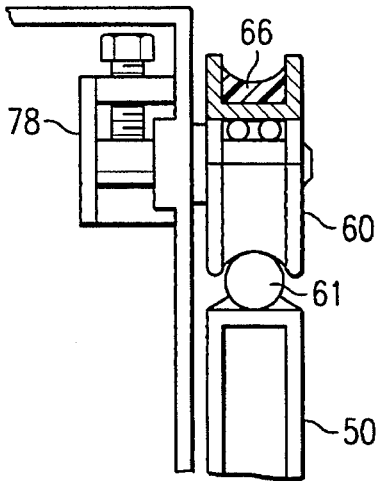
FIG. 4 is a detailed view of the rollers and mast of FIG. 3.

The carriage 54 is mounted for vertical motion along the length of the mast 50 through the rollers 60 as best seen in FIGS. 3 and 4. Rollers 60 engage mast roller guide bars 61 on each side of the mast. Preferably, eight rollers are used with the rollers 60 having a V-shape or U-shape cross section to engage the guide bars on the mast 50. The rollers are preferably covered by a soft abrasion resistant material 66, such as urethane, to improve wear life and reduce the noise level during operation.

An adjustment mechanism 78 may be employed to adjust the position of the rollers 60 relative to the mast roller guide bars 61. This permits the desired free floating action of the vibrator and tamping wheel assembly 14 to be maintained as the wheels wear during use.

The vibrator 56 is preferably a standard rotating eccentric weight vibrator as used on conventional utility cable plows. The vibrator is powered hydraulically from the power unit on the tractor.

The tamping wheel 58 is pinned to the vibrator tamping wheel assembly 14 by pin 59, permitting the tamping wheel 58 to rotate about axis 68 to enhance the compacting action. In a typical application, the tamping wheel is a 4" wide by 30" outside diameter sheep's foot style tamping wheel. The tamping wheel can also be a smooth roller or other configuration. This wheel and wheel yoke is pinned to the carriage 54 by two 1¼" connecting pins 64 installed in hardened steel bushings. This pinning method allows for easy conversion to a larger diameter and/or a wider or different style tamping wheel.

As can be understood, the weight of the vibrator and tamping wheel assembly 14 will cause it to slide down the mast and into contact with the soil placed in the trench by the backfill auger assembly. The vibration of the vibrator 56 and operation of the tamping wheel 58 will cause the soil to be compacted to a degree sufficient to restore the trench after several passes.

With the vibrator and tamping wheel assembly 14 free floating on the mast, a minimum amount of vibration is induced into the tractor, and the unit 10 is therefore more comfortable for the operator and provides reduced wear and damage to the tractor. Because less vibration is induced into the tractor, the amount of work (vibration) applied to the soil to be compacted is increased, resulting in a more efficient compaction effort than current art.

It will be readily understood that other methods of permitting the vibrator and tamping wheel assembly 14 to float on the mast are possible. However, unless the assembly is isolated from the mast and lift mechanism, vibration will be transmitted to the tractor and the operator, resulting in discomfort for the operator, damage to the equipment and reduced compaction efficiency.

After the compaction effort is complete, the lift mechanism 62 can be operated to lift the carriage 54 and tamping wheel 58 above the ground surface. The lift mechanism 62 includes a hydraulically operated winch 70 mounted at the top of the mast and a winch cable 72 attached to the carriage 54 for lifting the vibrator and tamping wheel assembly above the ground level. When the higher position is reached, a positive mechanical spring loaded retainer mechanism 74 will engage the carriage 54 and hold the vibrator and tamping wheel assembly 14 in the raised position mechanically. Mechanical retention of the mechanism is desired as the hydraulic motor of the winch will leak down after the power unit is shut off, allowing the vibrator and tamping wheel assembly 14 to move by gravity from the desired transport position. The vibrator and tamping wheel assembly lock mechanism 74 is engaged and disengaged through a push pull control cable 95 at the operator interface 18.

During operation, the vibrator and tamping wheel assembly 14 is lowered to a position engaging the soil to be compacted. The hydraulic valve in the winch 70 is positioned in a float orientation, allowing the cable drum to spool out cable 72 as the elevation of the soil in the trench and the surrounding surface conditions vary. Thus, the vibrator and tamping wheel assembly 14 is free floating along the length of the mast, which enhances the isolation of the assembly 14 from the rest of the tractor and results in greater compaction efficiency.

The vibrator 56 is controlled through a hydraulic valve that permits the operator at the operator interface 18 to select an infinite range of vibration frequency and amplitude. Thus, the operator can adjust the machine performance to optimize performance to the soil type and conditions experienced.

The mast 50 is preferable tilted toward the rear of the tractor as seen in FIG. 1 at about ten degrees. The mast tilt angle, however, can be changed by pivoting the mast about pin 52 to improve the vector 76 of force F and force angle $\alpha$ applied to the soil in a variety of soil types, tractor speeds and conditions. By directing the compaction force vector 76 in the optimum direction, the compaction is more efficiently and effectively conducted. In addition, the angle adjustment feature reduces the potential for the carriage mechanism to become bound to the mast. This is because the angle can be adjusted so that the force of the tamping is directed parallel the direction of movement of the vibrator and tamping wheel assembly 14 along the mast so that no force is actually exerted by assembly 14 into the mast. The angle change permits the carriage and roller assembly to roll up and down the mast more easily as soil conditions and types vary.

While unit 10 has been described as an integrated apparatus with transport, fill and compactor capabilities, it will be understood that various elements of the unit, such as the vibrator and tamping wheel assembly and the backfill auger assembly can be configured and adopted as an attachment to a standard trencher. In addition, a trencher can be attached to unit 10 to provide a complete installation and restoration machine.

The operator's area 82 is preferably located on the left side of the power unit 24. While in the operator's seat 84, the operator will be able to easily see the vibrator 56, the tamping wheel 58, the augers 32 and 34 and the trench 26. Tractor forward speed and direction control is achieved by depressing a foot pedal 86 located on the floor board at the operator's right. It can be readily understood that other methods of speed and direction control such as a hand operated vernier control handle is possible. Steering is controlled through a conventional steering wheel 88. Control of auger rotation, auger lift, vibrator operation and raising and lowering of the assembly 14 by the lift mechanism 62 is achieved by movement of various hydraulic control valve handles 90. All machine functions are controlled from the operator's position.

The operator will be protected from a machine rollover by a rollover protective structure (rops) 92 and seat belt 94.

Operator visibility is a primary concern. In order for the operator to work efficiently and safely, the trench 26, right of way 30, augers 32 and 34 and tamper wheel 58 must be easily seen from the operator's area. The configuration of the unit 20 provides the operator with excellent visibility.

With reference now to FIG. 6, a second embodiment of the present invention is illustrated as backfiller tamper machine 100. In all essential aspects, the machine 100 is identical to the machine 10. However, the machine 100 is adapted to be controlled by an operator walking behind the machine such as would be the case with a handlebar trencher or lawn mower. As can be understood other methods of operation may also be used such as an umbilical cord and remote radio control. The machine 100 has a control panel 102 with suitable controls as used on machine 10 to permit the operator to control the machine 100. The controls can either be mounted on handles extending rearward from the machine or at the rear of the machine, or a combination thereof, within ready access of the operator. Normally, a machine such as machine 100 would be downsized from the machine 10 with its components downsized correspondingly. Although the present invention has been described with respect to a specific preferred embodiment thereof, various changes and modifications may be suggested to one skilled in the art, and it is intended that the present invention encompass such changes and modifications as fall within the scope of the appended claims.

We claim:

1. An apparatus for backfilling and compacting soil into a trench, comprising:

a tractor;

a left and fight auger mounted on the tractor to move soil from the right of way into the trench, the augers being mounted on a vertically moveable element, the augers being mounted on the vertically moveable element by a pivoting connection to pivot about the vertically moveable element to allow the augers to float to facilitate the movement of a controlled amount of soil and to accommodate uneven terrain;

a tamper assembly mounted on the tractor to tamp the soil into the trench to restore the trench.

2. The apparatus of claim 1 wherein the tractor has a plurality of wheels, each wheel being separately powered by a hydraulic motor.

3. The apparatus of claim 1 wherein the tractor includes a mast, the tamper assembly being mounted on the mast for movement along the mast to isolate the tractor from the vibration of the tamper assembly and improve the compaction efficiency.

4. The apparatus of claim 1 wherein the left and right augers are positioned forward of the tamper assembly.

5. The apparatus of claim 1 wherein the tractor includes a mast, the mast pivotally mounted to the tractor and extending generally vertically, the tamper assembly being mounted for motion along the mast in the generally vertical direction.

6. The apparatus of claim 1 wherein the tamper assembly includes a vibrator and a tamping wheel.

7. The apparatus of claim 1, wherein the tractor further comprises front wheels and an operator's position and wherein the tamper assembly is mounted between the front wheels and forward of the operator's position to provide good vision of the augers and tamper assembly.

8. The apparatus of claim 1 further comprising an extension auger for mounting on at least one of said augers.

9. An apparatus for backfilling and compacting soil into a trench, comprising:

a tractor;

at least one auger mounted on the tractor to move soil from the right of way into the trench;

a tamper assembly mounted on the tractor to tamp the soil into the trench to restore the trench;

a mast mounted on the tractor, the tamper assembly being mounted for movement along the mast through rollers.

10. An apparatus for backfilling and compacting soil in a trench, comprising:

a tractor having a frame, a mast and a plurality of wheels, each of the wheels being individually driven by a hydraulic motor, the tractor having an operator position and a power unit for powering the apparatus;

a backfill auger assembly mounted on the tractor, the backfill auger assembly included a left and right auger mounted on the tractor in front of the front wheels to drive a controlled amount of soil from the right of way into the trench, the augers being mounted on a vertically moveable element, the augers being mounted on the vertically moveable element by a pivoting connection to pivot about the vertically moveable element to set the augers at an angle relative to the ground surface to facilitate the movement of a controlled amount of soil and to accommodate terrain variations;

a vibrator and tamping wheel assembly mounted on the mast of the tractor, the vibrator and tamping wheel assembly free floating along the mast to reduce transfer of vibration from the vibrator and tamping wheel assembly to the tractor and provide maximum utilization of the output force of the vibrator and tamping wheel assembly against the soil to be compacted, the vibrator and tamping wheel assembly including a vibrator, a tamping wheel, and rollers for mounting the vibrator and tamping wheel assembly on the mast.

11. The apparatus of claim 10 further comprising a lift mechanism to lift the vibrator and tamping wheel assembly vertically along the mast to a storage position.

12. The apparatus of claim 10 wherein the mast is pivotally mounted on the frame for pivotal motion for a limited arc from vertical to direct the compaction force at the soil within the trench at such an angle to provide maximum compaction force on the soil to be compacted and reduce the potential of the carriage mechanism to become bound to the mast.

13. A mechanism for tamping soil into a trench, comprising:

a frame;

a mast mounted to the frame;

a tamping wheel assembly mounted to the mast for movement along the length of the mast to compact the soil within the trench.

14. The mechanism of claim 13 wherein the mast is pivotally mounted to the frame for limited arcuate motion from vertical.

15. The mechanism of claim 13 wherein the tamping wheel assembly includes a vibrator and a tamping wheel, the weight of the tamping wheel assembly urging the tamping wheel assembly against the soil being compacted.

16. A method for backfilling and compacting soil into a trench, comprising the steps of:

moving a tractor along the trench and conditioning the soil by breaking up larger particles and cutting through compacted soil left on the right-of-way and compacted by the tires of the tractor;

moving a controlled amount of soil comprising a portion of the total accumulated spoil of the trench from the right-of-way to the trench with an auger mounted on the tractor, the moving comprising a lift; and compacting the lift within the trench to the desired density with a tamper assembly mounted on the tractor;

moving a controlled amount of soil comprising a portion of the total accumulated spoil of the trench from the right-of-way to the trench comprising a second lift; and compacting the second lift to the desired density with the tamper assembly;

repeating the moving and compacting steps until the trench is filled and the right-of-way is cleared of soil.

17. An apparatus for backfilling and compacting soil into a trench, comprising:

a tractor;

a backfill auger assembly mounted on the tractor, the backfill auger assembly including a left and right auger mounted on the tractor to drive a controlled amount of soil from the right of way into the trench, the augers being mounted on a vertically moveable element, the augers being mounted on the vertically moveable element by pivoting connection to pivot about the vertically moveable element to allow the augers to float to facilitate the movement of a controlled amount of soil and to accommodate uneven terrain;

a tamper assembly mounted on the tractor to tamp the soil into the trench to restore the trench; and at least one handle extending from the tractor for an operator to control the movement of the tractor, the operator walking behind or in close proximity to the tractor.

* * * * *